US006848285B2

(12) United States Patent
Stroh

(10) Patent No.: US 6,848,285 B2
(45) Date of Patent: Feb. 1, 2005

(54) MERCHANDIZE ITEM PROTECTION APPARATUS

(75) Inventor: Harald Stroh, Neuss (DE)

(73) Assignee: High-Scan-Artikelsicherungs-GmbH, Neuss (DE)

( * ) Notice: Subject to any disclaimer, the term of this patent is extended or adjusted under 35 U.S.C. 154(b) by 0 days.

(21) Appl. No.: 10/156,057

(22) Filed: May 29, 2002

(65) Prior Publication Data

US 2003/0221464 A1 Dec. 4, 2003

(30) Foreign Application Priority Data

May 29, 2001 (DE) ..... 101 26 288

(51) Int. Cl.[7] ..... E05B 65/00

(52) U.S. Cl. ..... 70/57.1; 70/63; 70/276; 206/1.5; 206/806; 340/572.9

(58) Field of Search ..... 70/57.1, 63, 276; 24/704.1; 206/1.5, 806, 493, 495; 340/572.8, 572.9

(56) References Cited

U.S. PATENT DOCUMENTS

| | | | | | |
|---|---|---|---|---|---|
| 4,104,622 | A | * | 8/1978 | Van Niel | 340/572 |
| 4,187,509 | A | | 2/1980 | Weiner | 343/873 |
| 4,590,461 | A | * | 5/1986 | Cooper | 340/572 |
| 4,627,534 | A | * | 12/1986 | Komiyama et al. | 206/387.1 |
| 4,987,754 | A | * | 1/1991 | Minasy et al. | 70/57.1 |
| 5,141,104 | A | * | 8/1992 | Morrow et al. | 206/5 |
| 5,144,345 | A | * | 9/1992 | Nyman | 351/158 |
| 5,390,515 | A | * | 2/1995 | Essick | 70/63 |
| 5,437,172 | A | | 8/1995 | Lamy et al. | 70/57.1 |
| 5,791,079 | A | * | 8/1998 | Mazzucchelli | 40/625 |
| 5,934,114 | A | * | 8/1999 | Weisburn et al. | 70/57.1 |
| 5,969,613 | A | * | 10/1999 | Yeager et al. | 340/572.9 |
| 5,988,462 | A | | 11/1999 | Kolton | D3/85 |
| 6,082,156 | A | * | 7/2000 | Bin | 70/57.1 |
| 6,182,480 | B1 | * | 2/2001 | Kim | 70/57.1 |
| 6,474,117 | B2 | * | 11/2002 | Okuno | 70/57.1 |
| 6,543,261 | B2 | * | 4/2003 | Kolton et al. | 70/57.1 |

FOREIGN PATENT DOCUMENTS

| | | | |
|---|---|---|---|
| EP | 21849 | * | 1/1981 |
| EP | 0212061 | | 3/1987 |
| FR | 2756468 | | 6/1998 |
| GB | 2075116 | * | 11/1981 |
| WO | WO 98/40591 | | 9/1998 |
| WO | WO 01/43101 | | 6/2001 |

* cited by examiner

*Primary Examiner*—Lloyd A. Gall
(74) *Attorney, Agent, or Firm*—Liniak, Berenato & White, LLC

(57) ABSTRACT

A merchandize item protection apparatus has a housing, with an alarm transducer received in the housing. A device for securing the housing to a merchandize item or merchandize to be protected is provided because the housing has a passthrough opening in order to hang a protected merchandize item or merchandize package on a merchandize presenter. The housing is constituted by two housing elements that are detachably joined to one another by the attachment device. A gap is formed between the housing elements, and in which a merchandize package can be clamped in place between the housing elements.

15 Claims, 1 Drawing Sheet

MERCHANDIZE ITEM PROTECTION APPARATUS

CROSS REFERENCE TO RELATED APPLICATIONS

Applicant claims priority to German patent application 101 26 288.4-32.

BACKGROUND OF THE INVENTION

1. Field of the Invention

The present invention concerns a merchandise item protection apparatus having a housing, an alarm transducer received in the housing, and a device for securing the housing to a merchandise item or merchandise package to be protected, the housing comprising a passthrough opening in order to hang a protected merchandise item or merchandise package on a merchandise presenter.

2. Description of the Related Art

Merchandise item protection apparatuses of this kind, also called "tags," are used in many stores to protect merchandise items from theft. The theft protection apparatuses possess an alarm transducer, for example based on an oscillator circuit, a transponder, or the like, and are attached to the merchandise item (or its packaging) that is to be protected in a manner that makes unauthorized removal of the merchandise item by customers impossible or at least considerably complicates it.

A merchandise item protection apparatus of the kind cited above is known from U.S. Pat. No. 5,437,172. This merchandise item protection apparatus possesses a plate-shaped basic body having a hook-shaped hanger, on which an alarm transducer is mounted. Also provided is a device for mounting a pair of eyeglasses on the merchandise item protection apparatus. Concretely, attachment of the glasses is accomplished by way of a narrow plastic strip that is placed around the bridge of the eyeglasses and is inserted with its two ends into a slot of the basic body, and in the inserted position can be locked by means of a peg on the attachment device.

Theft protection apparatuses that possess a housing and are attached to the textile merchandise items by way of a pin mounted on the housing, which is stuck through the textile material and is secured by a counterelement, are known for the protection of textile merchandise items, for example from U.S. Pat. No. 4,987,754.

For the protection of merchandise items that are sold in blister packs, for example headphones or wearable hands-free devices for mobile telephones, the protection apparatuses used are principally in the form of stick-on labels. This type of protection has a number of disadvantages, however. In the case of small products, for example, a thief can open the blister pack relatively unobtrusively and remove the merchandise item from it. A further problem is that the properties of the oscillator circuit or transponder transmission coil printed onto the label change in response to pressure or even in the vicinity of metal, so that they are not suitable for all products and also can be manipulated relatively easily.

It is therefore the object of the invention to describe a merchandise item protection apparatus of the kind cited initially that is suitable for protecting electronic products in blister packs.

SUMMARY OF THE INVENTION

According to the present invention, this object is achieved in that the housing is constituted by two housing elements that are detachably joined to one another by the attachment device; and a gap in which a merchandise package can be clamped in place is formed between the housing elements.

In contrast to the known merchandise item protection apparatuses in which a merchandise item is mounted directly on the merchandise item protection apparatus, the invention creates the possibility of protecting merchandise items in their packages, by the fact that they are clamped in place in the gap formed between the housing halves. Blister packs can thus be protected with no need to configure them specifically for that purpose, or to use particular attachment elements.

In particular, it is possible with the merchandise item protection apparatus according to the present invention to protect electronic components in their packages, the distance between the merchandise item and the alarm transducer being comparatively great so that the electronic components can have almost no influence on the properties of the alarm transducer.

The invention is also preferably suitable for the protection of blister packs, since the latter can be enclosed by the housing on their opening side in such a way that they can be opened only by destroying the package.

In a further embodiment of the invention, provision is made for one of the two housing elements to have a protrusion in which the passthrough opening is configured. In this case the housing element having the protrusion is slightly larger than the housing element without the protrusion, so that the protrusion having the passthrough opening projects out.

With regard to further advantageous embodiments of the invention, the reader is referred to the dependent claims and to the description below of an exemplary embodiment referring to the attached drawings, in which:

DETAILED DESCRIPTION OF THE PREFERRED EMBODIMENTS

Figure 2:
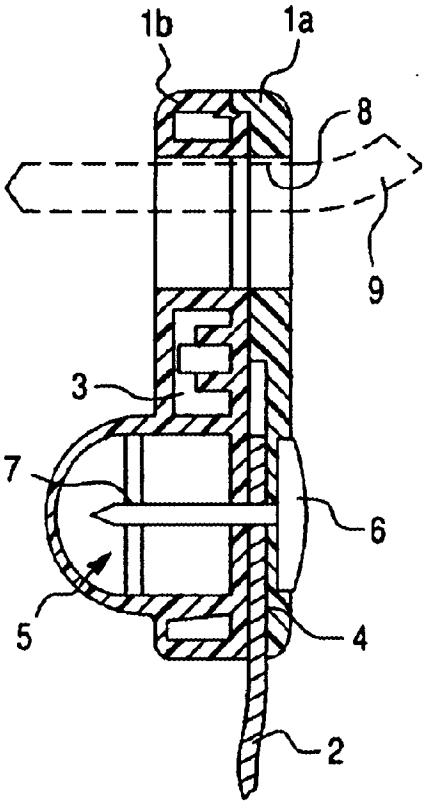
FIG. 2 shows the merchandise item protection apparatus of FIG. 1 in section along II—II.
Figure 1:
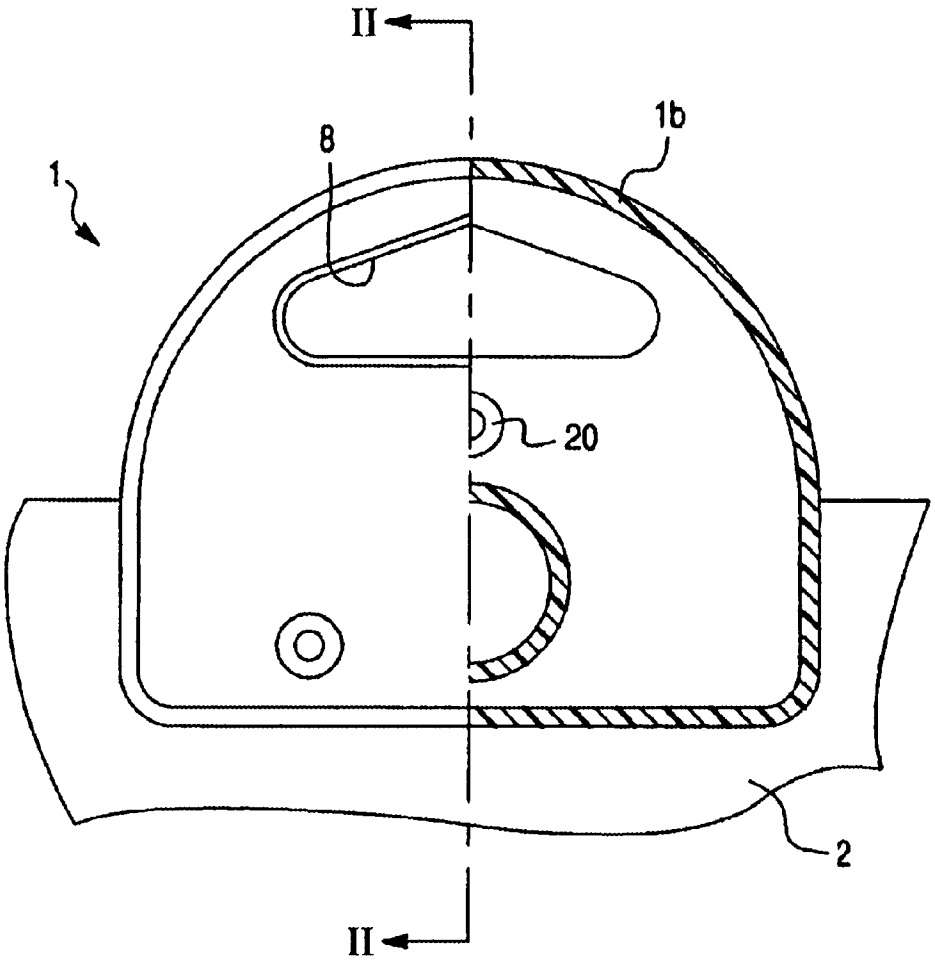
FIG. 1 shows a merchandise item protection apparatus according to the present invention in a partially sectioned front view.

FIGS. 1 and 2 depict an embodiment of a merchandise item protection apparatus according to the present invention, which is intended principally for the protection of merchandise items packaged in blister packs. The merchandise item protection apparatus possesses a housing 1 made of a dimensionally stable plastic material that is constituted by a basic housing body 1*b* in which a cavity 3 is formed for reception of an alarm transducer 20, and by a cover 1*a* retained releasably thereon. An attachment device is provided for releasably securing housing cover 1*a* to basic housing body 1*b*. Said device comprises a cyndrical pin 6 having a plenar head, mounted on housing cover 1*a*, that engages into a receptacle 7 provided on basic housing body 1*b* and is clamped in place therein by means of an attachment mechanism (also not depicted in further detail), in which context the connection can be released again in a manner known per se using a very strong magnet.

As is readily evident in particular from FIG. 2, there exists between housing cover 1*a* and basic body 1*b*, in the lower housing half in which the attachment device is also provided, a gap 4 in which blister pack 2 that is protected is clamped in place, and is additionally secured by means of pin 6 which penetrates through package 2. The gap 4 defines a longitudinal joining plane formed between the housing cover 1*a* and the basic body 1*b*.

In its upper half, housing 1 has a passthrough opening 8 with which the merchandise item protection apparatus, together with the protected merchandise item, can is be hung on a merchandise presenter, such as hook 9 that is depicted in FIG. 2.

In use, blister pack 2 that is to be protected is placed on basic housing body 1*b* in the region of the lower housing half, and housing elements 1*a*, 1*b* are then fitted together by setting housing cover 1 a onto basic housing body 1*b*, sticking pin 6 through blister pack 2 and guiding it into a passthrough opening provided in the blister pack, and inserting it into receptacle 7 of the attachment device. The pointed end of pin 6 faces a hemispherical cavity in FIG. 2. Blister pack 2 is thereby clamped in place between housing elements 1*a*, 1*b*. Blister pack 2 is in this manner reliably protected from theft, since practically the only way to misappropriate the packaged merchandise item is to tear open the blister pack. Such damage to the merchandise package represents a high psychological barrier, however, and is therefore improbable.

What is claimed is:

1. A merchandise item protection apparatus comprising a housing (1), an alarm transducer received in the housing (1), and an attachment device for securing the housing to a merchandise package (2) to be protected, the housing (1) comprising a passthrough opening (8) in order to hang said protected merchandise package (2) on a merchandise presenter (9), wherein the housing (1) comprises a first housing element and a second housing element, said first and second housing elements are detachably joined to one another by the attachment device (5); and a gap (4) in which said merchandise package is inserted such that said attachment device extends through said merchandise package and said merchandise package is clamped between said first housing element and said second housing element.

2. The merchandise item protection apparatus as defined in claim 1, wherein a first and second housing joining plane lies in a longitudinal plane of the housing (1).

3. The merchandise item protection apparatus as defined in claim 1, wherein the alarm transducer is received in a cavity (3) of one of the housing elements (1*a*, 1*b*).

4. The merchandise item protection apparatus as defined in claim 1, wherein the attachment device comprises a pin (6) having a planar head mounted on the first housing element (1*a*) and an essentially planar receptacle (7) for the pin (6) mounted on the second housing element.

5. The merchandise item protection apparatus as defined in claim 1, wherein said first housing element (1*a*) is adjacent from said second housing element, said first housing element comprising the passthrough opening (8).

6. The merchandise item protection apparatus as defined in claim 1, wherein the housing elements (1*a*, 1*b*) are injection-molded plastic parts.

7. A theft alarm system comprising a substantially planar first member, a second member, and a merchandise package, a planar attachment head, said attachment head having a cylindrical element extending perpendicular to said attachment head and detachably connected to said first member;

said second member having a first portion and a second portion, said first portion comprising a passthrough opening for a merchandise presenter and a cavity for an electrical transducer, said second portion comprising a planar receptacle;

said merchandise package being clamped between said first member and said second portion so that said cylindrical element engages said merchandise package and said planar receptacle, said merchandise package contacting and extending from said first and second members, and contacting and engaged with said cylindrical element.

8. The system as described in claim 7, wherein said first member has a first and second portion, said first member first portion contacting said second member first portion, said first member second portion contacting said merchandise package.

9. The system as described in claim 8, wherein said attachment head has a circular shape, said attachment head being disposed adjacent said first member second portion.

10. The system as described in claim 7, wherein said planar receptacle is magnetically detachable from said cylindrical element.

11. The system as described in claim 7, wherein said merchandise package can only be opened by destroying said package.

12. The system of claim 7, wherein said second portion of said second member has a hemispherical cavity, said hemispherical cavity encompassing said planar receptacle.

13. The system of claim 12, wherein said cylindrical element passes through a center of said planar receptacle and extends into said hemispherical cavity, said cylindrical element having a pointed end.

14. The system as described in claim 13, wherein a centerline of said passthrough opening coincides with a centerline of all of said first, said second member, said transducer, said attachment head, said cylindrical element, said planar receptacle and said hemispherical cavity.

15. The system as described in claim 7, wherein said attachment head, said cylindrical element, and said planar receptacle are disposed between said transducer and a merchandise item in said merchandise package.

* * * * *